United States Patent [19]

Takeshima

[11] 4,116,440

[45] Sep. 26, 1978

[54] GOLF CLUB GRIP

[75] Inventor: Hideyuki Takeshima, Kyoto, Japan

[73] Assignee: Hiroshi Kawamula, Tokyo, Japan

[21] Appl. No.: 730,607

[22] Filed: Oct. 7, 1976

[51] Int. Cl.[2] ..... A63B 53/14

[52] U.S. Cl. ..... 273/81.4; 273/81 B

[58] Field of Search ..... 273/72 R, 73 J, 75, 273/81 R, 81 B, 81 D, 81.3, 81.4–81.6, 165; 15/143 R; 145/61 R, 61 C, 61 L; 16/110 R, DIG. 12; 74/551.9

[56] References Cited

U.S. PATENT DOCUMENTS

| | | | |
|---|---|---|---|
| 1,528,648 | 3/1925 | Armstrong | 273/81 B |
| 1,532,679 | 4/1925 | Bradley | 273/81 B |
| 1,532,822 | 4/1925 | Kemp | 273/75 X |
| 2,088,008 | 7/1937 | Link | 273/81 B |
| 2,877,018 | 3/1959 | Turner | 273/81 B X |
| 3,198,520 | 8/1965 | Ahmuty | 273/81.4 |
| 3,971,094 | 7/1976 | Solf et al. | 15/143 R |

FOREIGN PATENT DOCUMENTS

| | | | |
|---|---|---|---|
| 6,763 | 4/1932 | Australia | 273/81 B |
| 9,232 of | 1913 | United Kingdom | 273/81.4 |
| 201,621 | 8/1923 | United Kingdom | 273/81 B |
| 409,325 | 4/1934 | United Kingdom | 273/81 B |

*Primary Examiner*—Richard J. Apley

*Attorney, Agent, or Firm*—Haseltine, Lake & Waters

[57] ABSTRACT

A hollow tapered generally cylindrical golf club grip made of an elastomeric material, of which at least the upper or thicker part grasped by the direction-determining hand (usually left hand) has an arcuate surface on the side touching ball (heel) of the thumb, and the remaining surface touching the other four fingers consists of 6 – 10 lateral planes is provided. When this grip is grasped by the direction-determining hand, the second joints of the fingers placed on one of the edges and thus the grip never slips from the hand.

2 Claims, 4 Drawing Figures

GOLF CLUB GRIP

BACKGROUND OF THE INVENTION

This invention relates to the golf club grip.

When a player strikes a golf ball with a club, normally his right hand serves to drive the ball and his left hand serves to determine the direction of the flying ball. Therefore, if the left hand or the direction-determining hand slips from the grasping position, the ball is driven to an undesired direction. With the conventional golf club, the grasping left hand often slips from the grip upon striking a ball.

This invention is to eliminate this defect of the conventional golf club grips.

SUMMARY OF THE INVENTION

This invention provides a cylindrical golf grip to be secured onto the shaft of a golf club shaft, said grip is easily slip from the grasping hand, wherein the above-mentioned defect of the conventional golf club grip is eliminated.

The golf club grip of this invention comprises a hollow tapered cylinder made of an elastomeric material, of which at least the upper or thicker part grasped by the left hand or the direction-determining hand has an arcuate surface on the side touching the heel (ball) of the thumb and the remaining surface touching the other four fingers comprises a plurality of lateral planes.

BRIEF DESCRIPTION OF THE ATTACHED DRAWINGS

DETAILED DESCRIPTION OF THE INVENTION

Now the invention is explained in detail in respect of a few embodiments thereof with reference to the attached drawings.

Figure 1:
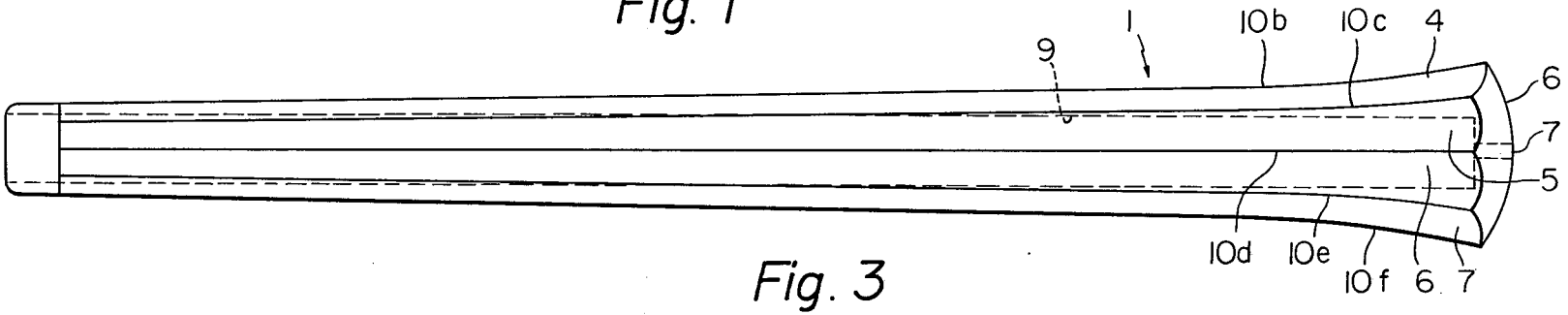
FIG. 1 is the side view representing an embodiment of this invention.

FIG. 1 represents an embodiment of this invention, in which the grip is generally shown as 1.

Figure 3:
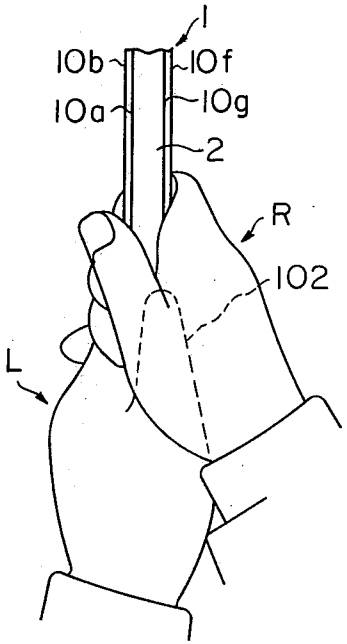
FIG. 3 is the plan view of the grip of FIG. 2 in use.

The golf club grip of this invention is made of an elastomeric material such as rubber and synthetic materials generally in the hollow tapered cylindrical shape. But at least the upper or thicker part thereof grasped by the left hand or the direction-determining hand has an arcuate surface 2 on the side touching the heel (ball) of the thumb and the remaining surface touching the other fingers consists of 6 lateral planes 3, 4, 5, 6, 7 and 8 in this embodiment as shown in FIGS. 1–3.

Figure 2:
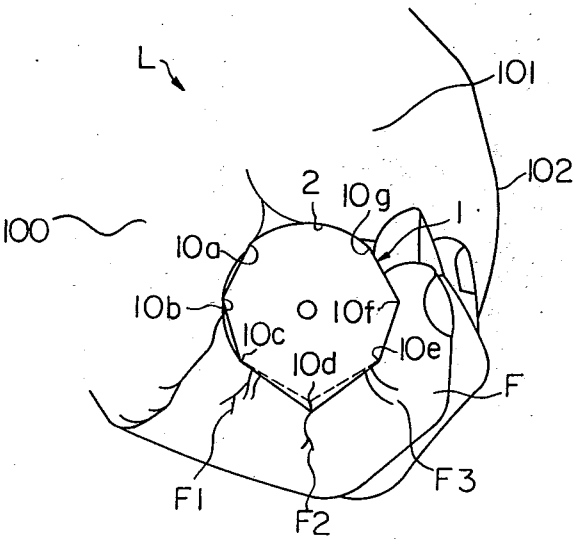
FIG. 2 is the end view of the embodiment of the invention of FIG. 1 in use.

In FIG. 2, the edges between the arcuate surface 2, the lateral faces 3, 4, 5, 6, 7 and 8 are indicated as 10*a*, 10*b*, 10*c*, 10*d*, 10*e*, 10*f* and 10*g*; and the broken line 9 (FIG. 1) indicates the inside surface of the grip. And in this embodiment, the edge opposite to the arcuate surface 2 is a little protruded, that is, the lateral faces 5 and 6 are broader than the other lateral faces. Number of the lateral faces is generally 6–10, preferably 6–8, and the most preferably 6. The breadth of each lateral face may not necessarily be equal and the cross section the grip of that portion may not necessarily be symmetrical. But the grip with an arcuate surface and 6 lateral faces and the symmetrical cross section, whereby the edge 10*d* opposite to the arcuate surface is a little protruded as shown in FIG. 2, is the most convenient in use and manufacturing.

Of course, the grip has an end plate 11 with a hole or vent 12. In the embodiment of FIG. 1, the edges extend to the thinner end of the grip, but the thinner part may be completely cylindrical.

Figure 4:
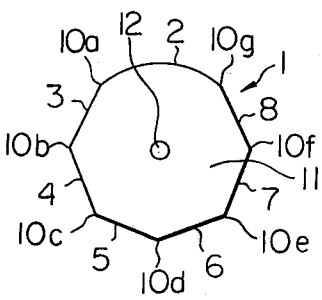
FIG. 4 is the end view of another embodiment of this invention.

FIG. 4 shows another embodiment of this invention, wherein the non-arcuate surface comprises 6 equal lateral surfaces, that is, the edge 10*d* opposite to the cylindrical surface is not especially protruded. Also the edges 10 are not necessarily be sharp lines but they may be more or less round.

The grip is secured to a golf club shaft so that the edge opposite to the arcuate surface is placed at the lowest position, that is, the position nearest to the earth surface when the club head is laid on the earth surface.

When a golf club with this grip is used, the thicker or edged end part is tightly gripped by the left hand as shown in in FIG. 2 and FIG. 3, wherein L represents the left hand, R represents the right hand, 100 represents the palm, 101 represents the ball (heel) of the thumb, 102 represents the thumb of the left hand, F represents fingers, and F1 represents the first joints of the fingers, F2 the second joints and F3 the third joints.

That is, the grip is tightly held in the left hand L so that the thumb 101, 102 is placed on the arcuate surface 2 and the second joints F2 of the other fingers are placed along the edge 10*d* opposite to said arcuate surface. And the right hand grasp the grip overwrapping the left hand as shown in FIG. 3. Thus the left hand firmly grasps the grip by pressure applied on the arcuate surface by the thumb and the engagement of the edge opposite to said arcuate surface and the second joints of the fingers and thus the grip never slips from the left hand.

Therefore, number of the lateral planes may not necessarily be even number. The grip may be designed so that it may have an odd number of lateral planes plus an arcuate surface whereby one edge may be placed at the position corresponding to the second joints of the four fingers.

The invention has been explained specifically with respect to the golf club grip for the right-handed player.

However, it will be needless to say that the principle of this invention can be applied to the grip for the left-handed player, too.

Thus having described my invention, I claim:

1. An improved tapered generally cylindrical golf club grip formed of elastomeric material, the improvement comprises: providing the surfaces of said grip with an arcuate surface and six planar surfaces disposed to provide a symmetrical grip when taken in cross-section and having two planar surfaces disposed opposite to the arcuate surface broader in width than the other four planar surfaces, to thereby form an extended edge surface therebetween.

2. The golf club grip as set forth in claim 1, in which edges between the arcuate surface and planar surface are round.

* * * * *